United States Patent [19]

Kahn

[11] 4,162,700

[45] Jul. 31, 1979

[54] MECHANISMS FOR CONTROLLING TEMPERATURE AND HEAT BALANCE OF MOLDS

[76] Inventor: Friedhelm Kahn, 2, Mühlbachstrasse, D 6332 Ehringshausen, Fed. Rep. of Germany

[21] Appl. No.: 847,109

[22] Filed: Oct. 31, 1977

[51] Int. Cl.[2] ..... B22D 27/04; B22D 15/00

[52] U.S. Cl. ..... 164/154; 164/60; 164/126; 164/338 M; 164/348

[58] Field of Search ..... 164/60, 122, 125, 128, 164/154, 348, 353, 338

[56] References Cited

U.S. PATENT DOCUMENTS

| | | | |
|---|---|---|---|
| 3,417,809 | 12/1968 | Sink | 164/353 X |
| 3,633,656 | 1/1972 | Saunders | 164/348 |

*Primary Examiner*—Robert D. Baldwin
*Attorney, Agent, or Firm*—Gilbert L. Wells

[57] ABSTRACT

This disclosure covers a process and mechanisms for controlling the temperature and heat balance of molds. More particularly, this invention relates to molds with built-in devices for heating and cooling various regions within molds. These devices are so constructed that each device is capable of heating and cooling independent of the other devices. The intensity of heating and cooling of these devices can be varied by regulating the flow of the heating/cooling medium in impulses for variable intervals of time. Prior to filling of the mold, the mold is heated to the desired working temperature by injecting a heated medium into the various heating-/cooling devices. During or immediately after filling the mold, the flow of the heated medium to the device furthest from the casting riser (feeder) is discontinued and is replaced by a flow of cooling medium. When the material within the mold in the immediate vicinity of this device is solidified, the flow of cooling medium to this device is decreased or stopped. The remaining heating/cooling devices are then sequentially activated in the same manner as the first with activation occurring in a direction toward the casting riser. Thus, solidification is controlled in a directional manner so that it progresses from the region in the mold furthest from the casting riser toward the riser.

5 Claims, 4 Drawing Figures

MECHANISMS FOR CONTROLLING TEMPERATURE AND HEAT BALANCE OF MOLDS

BACKGROUND OF THE INVENTION

This invention relates to a process and the mechanisms for controlling the temperature and heat balance of molds through the use of heating and/or cooling devices.

In the foundry literature as well as in practice many methods are known which attempt to influence the heat balance and temperature of molds, in order to produce pore-free, fine-grained, stress-free, crack-free castings as well as to decrease the cycle time of casting. All of these methods are slow and ineffective or totally unable to control the mold temperature and heat flow within sufficiently small regions of the mold or to control the sequence of cooling from point to point within the mold during one casting cycle. Such control is essential to promote controlled, directional solidification of the individual casting.

As described by Seidel, "Zweckmässiges Heizen und Kühlen von Druckgiessformen mit entsprechenden Temperatur-Regelgeräten" GIESSEREI, 25, 1973 pp. 794–797 heating and cooling devices with temperature control have been employed in die casting molds to increase the production rate sufficiently to offset the large investment in molds and auxiliary heating and cooling equipment.

The installation of heating and cooling devices in the die casting molds in this instance are expensive due to extensive machining and sealing requirements. Variations in temperature within the die casting mold are in this case ineffective in providing directional solidification of the individual casting, indeed controlled solidification is not possible and not considered due to the extremely short time required for solidification.

An article published by Meyer, e.a., "Calcul des Canaux de Refroidissement" FONDERIE, July, 1976 pp. 251–264 describes the possibilities of mathematically establishing the dimensions of cooling channels for die casting molds. In this instance the aim was to establish a constant mold temperature after a given number of casting cycles to achieve an increase in the rate of production.

Thus, there still exists a need for a process and the mechanisms for promoting controlled, directional solidification of the single casting to insure pore-free, high-quality products at low cost. The process and mechanisms described in this invention fulfill the conditions necessary for developing controlled, directional and accelerated solidification.

SUMMARY OF THE INVENTION

This disclosure relates to molds with built-in devices for heating and cooling various regions within molds. The supply system for heating and cooling medium is so constructed that each device is capable of heating and cooling independent of the other devices. The intensity of heating and cooling of said devices is variable by regulating the flow of heating or cooling mediums in impulses for variable intervals of time. Molds are heated to the desired working temperatures prior to starting the production of castings by injecting a heated medium into the various heating/cooling devices. During or immediately upon filling the mold, the flow of the heated medium to the device furthest from the casting riser (feeder) is discontinued and is replaced by a flow of cooling medium. When the material within the mold within the immediate vicinity of this device is solidified, the flow of cooling medium is decreased or discontinued. The remaining heating/cooling devices are then sequentially activated in a like manner as the first with activation of the individual devices occuring in a direction toward the casting riser. Hence, solidification is controlled so that it progresses in a directional manner from the region in the mold furthest from the casting riser toward the riser. Decreasing or discontinuing the flow of cooling medium to the various heating/cooling devices following solidification permits the heat emanating from the casting to be used to provide the temperature distribution in the devices and in the mold which existed immediately prior to mold filling. Upon removal of the casting, the process can be repeated. Controlled solidification, as provided by the process and mechanisms described in this invention, results in homogeneous, fine-grained castings free of shrinkage pores, cracks, or residual stresses in shortest possible cycle time.

Larger and more complex molds may get several feeding and cooling zones. Furthermore, this invention offers special advantages for casting processes in which the metal is gated and fed from the bottom of the mold to the casting as described by Kahn, "Zur Bedeutung der Konvektion für die Erstarrungslenkung von Guswerkstoffen" GIESSEREI FORSCHUNG, 24, (1972) pp. 115–131 and as practiced, for example, in the low pressure diecasting process. In such casting processes the rate of solidification of the metal decreases greatly, as the solidification front nears the sprue/feeder on the underside of the casting, resulting in a relatively long cycle time. The new method of cooling incorporated in this disclosure can eliminate this serious disadvantage of long cycle time by accelerated solidification of the casting through controlled cooling of the mold in the vicinity of the sprue/feeder.

Controlled heating of molds as described in this disclosure, can eliminate the conventional practice of externally heating molds with gas burners, thereby greatly reducing overheating localized regions of the molds and the greater wear of critical mold components such as ejection pins. In addition damage of expensive auxiliary mold equipment such as hydraulic systems and manipulators from overheating can be largely prevented.

Preheating of denseners as components of e.g. sand molds with gas burners before casting is avoidable.

Furthermore, the elimination of open flames from gas burners results in much cleaner and more comfortable working conditions.

BRIEF DESCRIPTION OF DRAWINGS

The drawings schematically illustrate four examples of how this invention can be implemented.

DETAILED DESCRIPTION OF PREFERRED EMBODIMENT

Figure 1:
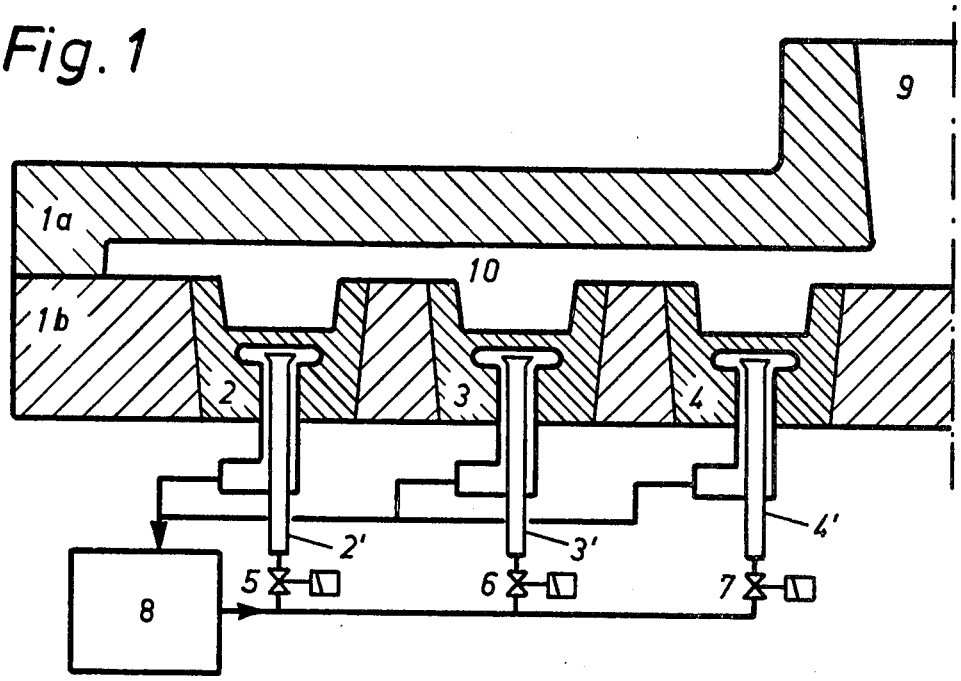
FIG. 1 is a vertical cross-section through a mold having three heating/cooling devices and the required heating/cooling system and transfer piping for the heating/cooling mediums.

In the practice of this invention permanent or expendable molds, e.g. sand molds, are provided with heating-/cooling devices for heating and cooling various regions within these molds to allow controlled solidification. For convenience, and without intending to unduly restrict the invention, a typical permanent mold is shown in FIG. 1. Said mold is characterized by an upper half 1*a* and a lower half 1*b* and contains three heating/cooling devices 2, 3, and 4. Said devices are connected by a tubing system to a heating/cooling system 8 with the transfer of the heating/cooling mediums controlled by, e.g. electromagnetically actuated valves 5, 6, and 7.

Before filling the mold the devices 2, 3 and 4 are heated by causing a heating medium generated in the heating/cooling system 8 (e.g. super-heated steam) to be transfered through the tubes 2', 3', and 4' into the devices 2, 3, and 4. Once the mold has achieved the desired temperature, the melt is introduced through the riser/sprue 9 into the mold cavity 10. During or immediately upon filling the mold, the control of solidification is initiated by causing a cooling medium to be directed from the heating/cooling system 8 into the device 2 which is constructed of a material possessing a higher thermal conductivity than the main body of the mold. The intensive extraction of heat from the casting in the vicinity of device 2 is halted or is greatly reduced as soon as solidification of the casting in the region of device 2 is completed. At this instant cooling medium is directed into device 3 to continue the process of controlled solidification toward the riser/sprue 9. Cooling medium is directed to device 4 following complete solidification of the casting in the vicinity of device 3. Solidification of the casting is completed in the riser/-sprue 9 after device 4 has achieved its maximum cooling intensity. Heat is further extracted from the casting and the devices are reheated until the proper temperature for removing the casting from the mold is achieved. The mold is then opened, the casting removed, and the temperature of the mold surfaces measured with, e.g., an infrared temperature measuring device prior to closing of the mold for the next casting cycle.

Materials particularly suited for such heating/cooling devices are essentially pure metals such as copper or nickel or low-alloyed copper alloys such as beryllium copper. Materials suitable for the main body of the molds are alloys such as gray iron, warmworking steels or other heat resistant materials. As a cooling medium water is an excellent choice. When water is injected into the cooling devices under sufficient pressure, it will extract a large quantity of heat upon vaporizing.

Thermocouples for controlling the heating/cooling medium supply can be located in the various heating-/cooling devices as well as in other locations in the mold. Other heating and cooling mediums than those mentioned above can be employed.

Figure 2:
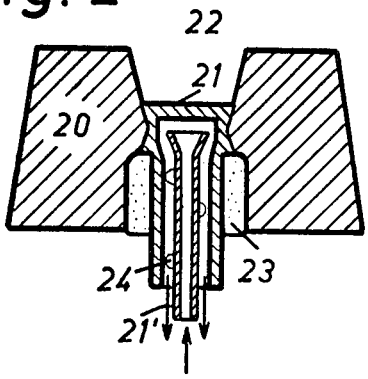
FIG. 2 is a vertical cross-section through a cooling device which can be integrally fastened to the main body of the mold by compound casting, soldering, brazing, welding or mechanical attachment.

FIG. 2 shows a component 20 of a permanent mold with a cast-in heating/cooling device 21 whose surface is partially in direct contact with a casting which is positioned at 22. This configuration is especially effective for intensive heat removal within a very localized region. In order to limit the cooling effect to as small a region as possible, part of the surface of the device is separated by an insulating sleeve 23 from the lower portion of the component 20. The heating/cooling device tube 21' for transmitting heating/cooling mediums is constructed of a material with low thermal conductivity and is centered within the device by means of small protuberances 24 which are an integral part of the tube 21'.

Figure 3:
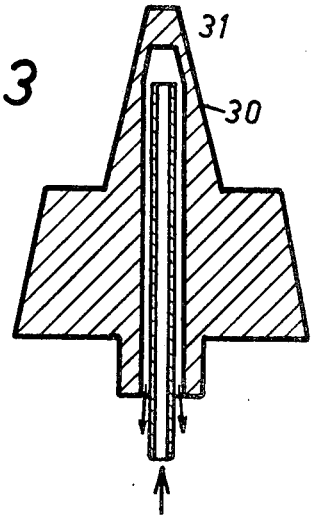
FIG. 3 is a vertical cross-section through a heating-/cooling device which can be integrally fastened by similar way.

A further example of a heating/cooling device is shown in FIG. 3, where the surface 30 is the desired configuration tobe produced in the casting which is positioned at 31. The concentration of heat occurring in such a region which would lead to shorter mold life in conventional molds is effectively removed by employing the heating/cooling device in the cooling mode.

Figure 4:
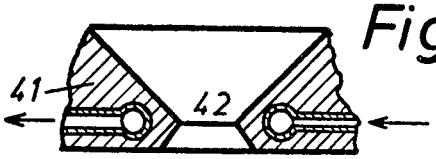
FIG. 4 is a vertical cross-section through a circular cooling device.

Lastly, FIG. 4 illustrates a possibility for controlling the solidification and cooling of a casting in the region of a riser, the so-called mouth of the riser 42, by means of a circular heating/cooling device 41.

I claim:

1. Apparatus for casting and controlling the mold heat input and output comprising:
   (a) an upper mold half with a riser therein;
   (b) a lower mold half with a plurality of combined heating and cooling devices located therein, each of said devices laterally spaced sequentially from a lesser to a greater distance away from said riser;
   (c) each of said devices communicating with means for independently supplying heating and cooling mediums thereto; and
   (d) control means for initially simultaneously supplying said heating medium to each said device and then selectively supplying said cooling medium thereto beginning with said device at said greater distance and proceeding sequentially to said lesser distance for directional solidification in said mold halves beginning at said greater distance and proceeding to said lesser distance.

2. The apparatus of claim 1, wherein said means for supplying heating and cooling medium have means therein for delivering a heating medium, means to discontinue delivery of said heating medium, a cooling medium reservoir, fluid conduits connecting each of said devices in series with said reservoir, and wherein said control means includes electromagnetically actuated valves in each of said conduits.

3. The apparatus of claim 1, wherein said mold halves have a given thermal conductivity and said devices have a greater thermal conductivity than said given conductivity.

4. The apparatus of claim 1, wherein said mold halves are castings and said devices are cavities in said castings.

5. The apparatus of claim 4, wherein said conduits have low thermal conductivity and said conduits have thermal insulation between said conduits and said lower mold half.

* * * * *